US007165934B2

(12) United States Patent
Reigl

(10) Patent No.: US 7,165,934 B2
(45) Date of Patent: Jan. 23, 2007

(54) STEAM TURBINE AND METHOD FOR THE PRODUCTION OF SUCH A STEAM TURBINE

(75) Inventor: Martin Reigl, Untersiggenthal (CH)

(73) Assignee: Alstom Technology, Ltd., Baden (CH)

( * ) Notice: Subject to any disclaimer, the term of this patent is extended or adjusted under 35 U.S.C. 154(b) by 218 days.

(21) Appl. No.: 10/987,694

(22) Filed: Nov. 12, 2004

(65) Prior Publication Data

US 2005/0106006 A1 May 19, 2005

(30) Foreign Application Priority Data

Nov. 15, 2003 (DE) ..... 103 53 451

(51) Int. Cl.
*F01D 25/26* (2006.01)

(52) U.S. Cl. ..... 415/108; 415/214.1; 415/215.1

(58) Field of Classification Search ..... 415/108, 415/100

See application file for complete search history.

(56) References Cited

U.S. PATENT DOCUMENTS 3,773,431 A * 11/1973 Bellati et al. ..... 415/108
5,695,317 A 12/1997 Ritter ..... 415/108
6,315,520 B1 11/2001 Haje et al. ..... 415/178

FOREIGN PATENT DOCUMENTS

| | | |
|---|---|---|
| DE | 420 755 | 10/1925 |
| DE | 1 708 011 | 4/1971 |
| DE | 43 10 773 | 10/1994 |
| EP | 0 952 311 | 10/1999 |
| GB | 230843 | 3/1925 |

* cited by examiner

*Primary Examiner*—Richard A. Edgar
(74) *Attorney, Agent, or Firm*—Darby & Darby

(57) ABSTRACT

A steam turbine including a rotor rotatable about an axis and a casing concentrically surrounding the rotor. A reduction in the starting times and reduced production costs may be achieved in that the casing includes a high-mass hollow-cylindrical basic carrier and a plurality of shells concentrically surrounding the basic carrier. The shells are each produced from a bent metal sheet and interspaces capable of being filled with steam are defined between adjacent ones of the plurality of shells.

20 Claims, 6 Drawing Sheets

STEAM TURBINE AND METHOD FOR THE PRODUCTION OF SUCH A STEAM TURBINE

Priority is claimed to German Patent Application No. DE 103 53 451.2, filed on Nov. 15, 2003, the entire disclosure of which is incorporated by reference herein.

The present invention relates generally to steam turbines and particularly to a steam turbine with a rotor rotatable about an axis and surrounded concentrically by a casing.

BACKGROUND

Steam turbines of the modern type of construction for high efficiencies and high steam inlet temperatures comprise a rotor which is rotatable about an axis of rotation and which is surrounded by a casing. The casing is subdivided into an inner casing, which surrounds the rotor concentrically, and an outer casing, which surrounds the inner casing together with the rotor. Between the rotor and the inner casing is formed a steam duct which is in the form of an annular gap and through which the steam is conducted for the performance of work. The blading of the steam turbine is arranged in the steam duct and consists of alternately arranged rings of stationary guide vanes and of moving blades fastened on the rotor. The guide vanes are arranged on the inner wall of the inner casing, said inner wall delimiting the steam duct (see, for example, EP-A1-0 952 311 or U.S. Pat. No. 5,695,317 or U.S. Pat. No. B1-6,315,520).

Both the outer casing and the inner casing are conventionally horizontally divided thick-walled castings composed of a comparatively costly high-temperature alloy. For example, a steel casting is used for the outer casing. The inner casing, exposed to especially high pressures and temperatures, mostly consists of a special nickel-based alloy. Steam turbines with steam inlet temperatures of about 700° C. or above are currently in the planning stage. Pressures of several 100 bar, for example 350 bar, occur in this case.

According to current estimates, the starting time of steam turbines of the type described amounts to several hours, since, because of the large dimensions and wall thicknesses, the rotors and the casing require a long time before they can be heated to the operating temperature, without excessively high thermal stresses being generated. Further disadvantages of a high-mass inner casing are the high costs, since the nickel-based alloy is a very costly material. Also, for such large castings, there are long delivery times of several months. Since the inner casings are divided and the parts are screwed to one another via flanged connections, high-mass parting line flanges are present which make up a considerable proportion of the entire casing weight. Large and costly parting line screws for the flanged screw connection also have to be employed correspondingly.

SUMMARY OF THE INVENTION

An object of the present invention is to provide a steam turbine that avoids the described disadvantages of known steam turbines and is distinguished, particularly by virtue of a novel casing design, by a reduced starting time during operation and by more cost-effective and quicker production. A further or alternate object of the present invention is to specify a method for the production of such a steam turbine.

The present invention provides a steam turbine (10,40,50) with a rotor (18) rotatable about an axis (47) and surrounded concentrically by a casing (11), characterized in that the casing (11) comprises a high-mass hollow-cylindrical basic carrier (21) and a plurality of shells (21,12,22,13,23, . . . ,17,27) which surround the basic carrier (21) concentrically and are produced from a bent metal sheet and between which interspaces (48) capable of being filled with steam are provided.

The casing is constructed from a high-mass hollow-cylindrical basic carrier and a plurality of shells which surround the basic carrier concentrically and are produced from a bent metal sheet, interspaces capable of being filled with steam being provided between these shells. Instead of a high-mass cast inner casing which absorbs both the internal pressure and the shearing force, therefore, sheets, preferably in standard dimensions, are used in a plurality of layers. These absorb essentially only the internal pressure. The guide vanes are mounted in the basic carrier when the casing is an inner casing. Said basic carrier absorbs essentially only the shearing force and the load moment and transmits the shearing force to the axial guide and the load moment to the supports. The casing is mounted and guided via the basic carrier. The basic carrier is subjected to little internal pressure stress and can therefore be constructed with a small wall thickness.

A preferred embodiment of the present invention is distinguished in that the basic carrier is composed of a plurality of annular carrier segments arranged one behind the other in the axial direction and connected to one another, in that the shells have a barrel-shaped design, the next outer shell in each case surrounding all the further inward-lying shells both in the radial and in the axial direction, and in that the shells are connected on the end faces in each case to one of the carrier segments of the basic carrier in a steamtight manner. By the basic carrier being divided axially into segments connected to one another, the production of the casing is simplified considerably.

Good accessibility for assembly and maintenance is achieved in that the basic carrier and the shells are subdivided in a horizontal midplane into an upper and a lower part or into upper and lower segment halves and into upper and lower shells which are in each case screwed to one another in pairs via flanged screw connections. Preferably, to form the flanged screw connections, in each case horizontal flanges are attached, in particular welded, to the upper and lower shells.

Assembly may be further simplified in that the upper shells are in each case screwed to the upper segment halves, preferably via a semiannular flanged connection, and in that the lower shells are in each case welded to the lower segment halves.

So that the pressure drop from the inside outward can be apportioned correctly to the individual shells, it is advantageous that the carrier segments of the basic carrier are connected to one another in such a way that steam can flow out of the interior of the basic carrier into the interspaces between the shells.

Another embodiment of the present invention is characterized in that the steam for operating the steam turbine is conducted to the rotor from outside through all the shells of the casing by means of at least one inlet pipe, and in that the at least one inlet pipe, in its passage through a shell, is in each case sealed off by means of a piston ring seal.

In particular, the casing may be an inner casing or a combined inner and outer casing, there being formed, between the basic carrier and the rotor, a steam duct, in which is arranged a blading comprising guide vanes and moving blades, and the guide vanes of the blading being fastened to the inner wall of the basic carrier. The casing may in this case be of single-flow or double-flow design.

The casing may, however, also be an outer casing. The basic carrier then carries no blading on the inside, but seals instead.

Preferably, the shells are produced in each case from a standard metal sheet consisting of a high-temperature nickel-based alloy, in particular of Alloy 617, with a sheet thickness, dependent on the position of the shell in the casing, of several millimeters, in particular of between 3 and 11 millimeters.

A less costly material, preferably rolled sheet steel, may also be used in the outer shells, in which the steam temperature is markedly lower than in the inner shell.

BRIEF DESCRIPTION OF THE DRAWINGS

The present invention will be explained in more detail below by means of exemplary embodiments, with reference to the drawings in which.

DETAILED DESCRIPTION

The present invention is based on arranging a large number of bent sheets one behind the other instead of a high-mass cast casing or inner casing. Since the sheets are comparatively thin and are effectively insulated from one another thermally by means of the gap lying between them, the thermal stresses are low. The casing is therefore suitable for starting in a very short time. Further advantages are:

The delivery time is markedly shorter than where cast casings are concerned, since the sheets are commercially available. With standard dimensions, the sheets are already available in commercial depots. Alternatively, a specific depot may be set up.

A smaller quantity of costly nickel-based material is required, specifically for three reasons:

On account of the insulation of the sheets from one another, the temperature decreases sharply from the inner shell to the outer shell. A more cost-effective material can therefore be used in the colder outer shells.

Owing to the sharper temperature drop from the inner shell to the outer shell, as compared with the conventional cast casing, the temperatures in the outer shells are lower. Accordingly, the material strength, which increases with a decrease in temperature, is higher there, so that a smaller wall thickness of the shell is sufficient.

The high-mass parting line flange of a conventional cast casing forms a considerable proportion of the entire casing weight. In the casings according to the present invention, because of the low pressure difference from shell to shell, only very small flanges, which are very light as compared with the casing shell, are required.

The parting line screws of the flanged screw connections in the case of the shells divided in a horizontal midplane can have a very small design, as compared with conventional parting line screws. As a result, on the one hand, they can be delivered more quickly, since commercially available thin raw material can be used for manufacture. On the other hand, they can be produced more cost-effectively, since the commercially available raw material is more cost-effective and since they can be manufactured on smaller machines.

Instead of a high-mass cast inner casing which absorbs both the internal pressure and the shearing force, sheets in standard dimensions are used in a plurality of shells. These absorb essentially only the internal pressure. The guide vanes are mounted in the basic carrier. The latter absorbs essentially only the shearing force and the load moment and transmits the shearing force to the axial guide and the load moment to the supports. The casing is mounted and guided via the basic carrier. The basic carrier is subjected to almost no internal pressure stress and can therefore be constructed with a small wall thickness.

Figure 1:
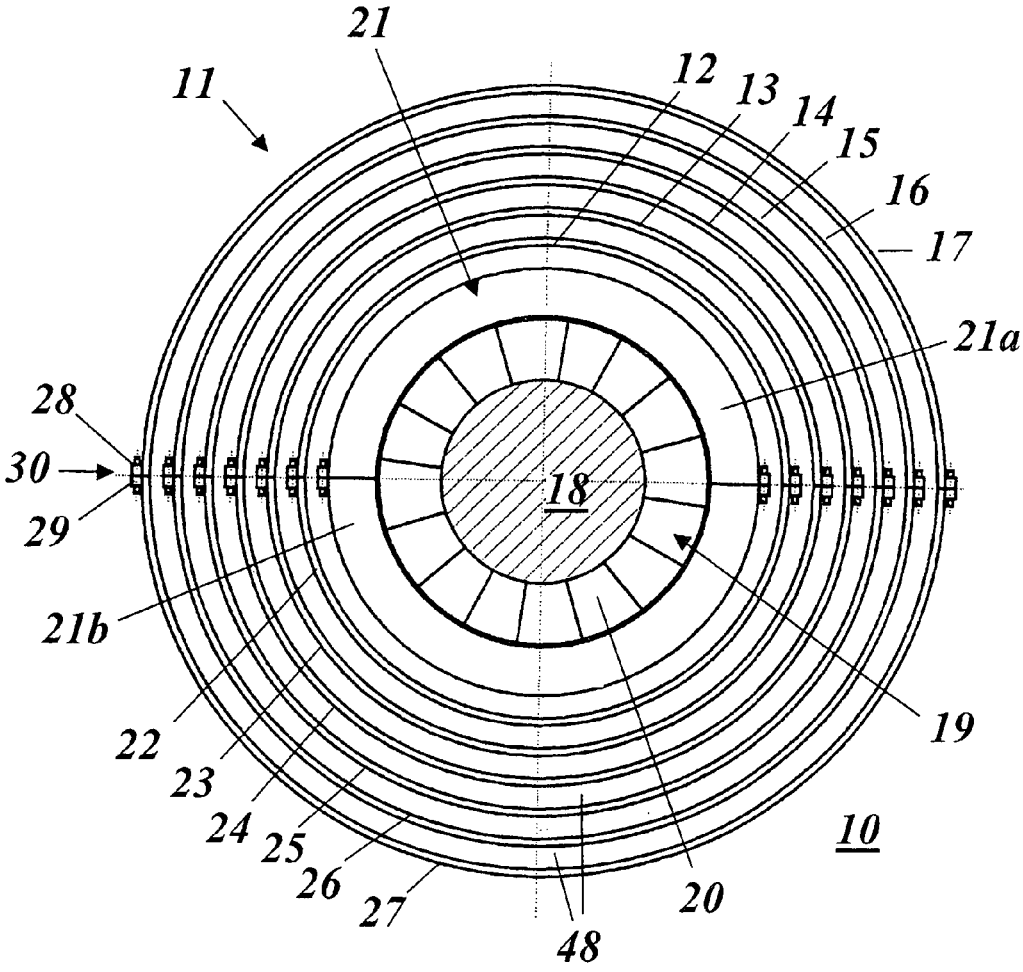
FIG. 1 shows a cross section through the set-up of a multishell inner casing of a steam turbine according to a first preferred exemplary embodiment of the present invention.

FIG. 1 shows the basic principle in a cross-sectional illustration by means of an exemplary embodiment: the inner casing 11 of a steam turbine 10, said inner casing surrounding a rotor 18 concentrically, is illustrated. Between the rotor 18 and the inner casing 11, a steam duct 20 in the form of an annular gap is left free, in which is arranged a blading 19 comprising guide vanes and moving blades.

Metal sheets bent into a barrel shape and having a thickness of a few millimeters, preferably of between 2 and 11 millimeters, which consist of the here six upper shells (upper halves) 12, 13, 14, 15, 16 and 17 and of the six lower shells (lower halves) 22, 23, 24, 25, 26 and 27, are laid in the manner of onion skins around the steam duct 20 and the rotor 18. The upper and lower shells are fixed to one another in each case via a welded-on small horizontal flange 28, 29 (see also FIG. 2) and a flanged screw connection 30. The guide vanes in the steam duct 20 are mounted on a basic carrier 21 which likewise consists of an upper part 21*a* and of a lower part 21*b* which are both fixed to one another by means of a small flange (horizontal flange halves 52, 53 in FIGS. 5 and 6) and a flanged screw connection 30. Between the upper and lower shells 12, . . . , 17 and 22, . . . , 27, interspaces 48 are left free which are filled with steam via orifices in the basic carrier 21 during operation. The steam pressure decreases from the inside outward from interspace to interspace of the upper and lower shells 12, . . . ,17 and 22, . . . ,27.

Figure 2:
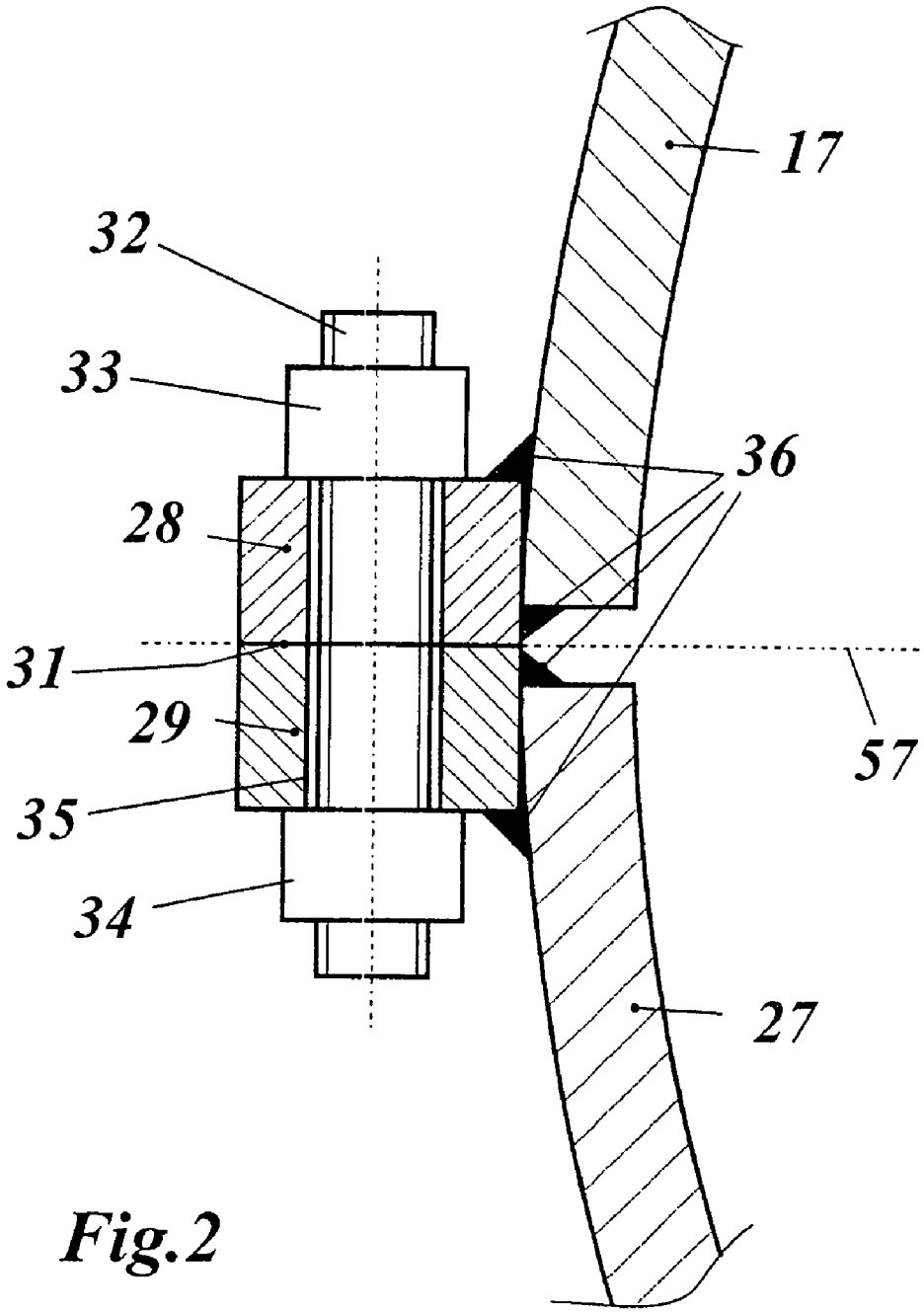
FIG. 2 shows, in the form of an enlarged detail, the flanged connection of an upper and a lower shell of the exemplary inner casing from FIG. 1.

FIG. 2 shows, in the form of an enlarged detail, an exemplary horizontal flanged connection of the upper and lower shells from FIG. 1 (flanged screw connection 30 in FIG. 1). In FIG. 2, an upper shell 17 is welded to a flange upper part 28. The lower shell 27 is welded to the flange lower part 29. The associated weld seams are given the reference symbol 36. A screw bolt 32 is inserted through in bores 35 in the flange upper part 28 and lower part 29, said screw being braced by means of nuts 33 and 34 and sealing off the parting line 31 between the flange upper part 28 and the flange lower part 29.

Figure 3:
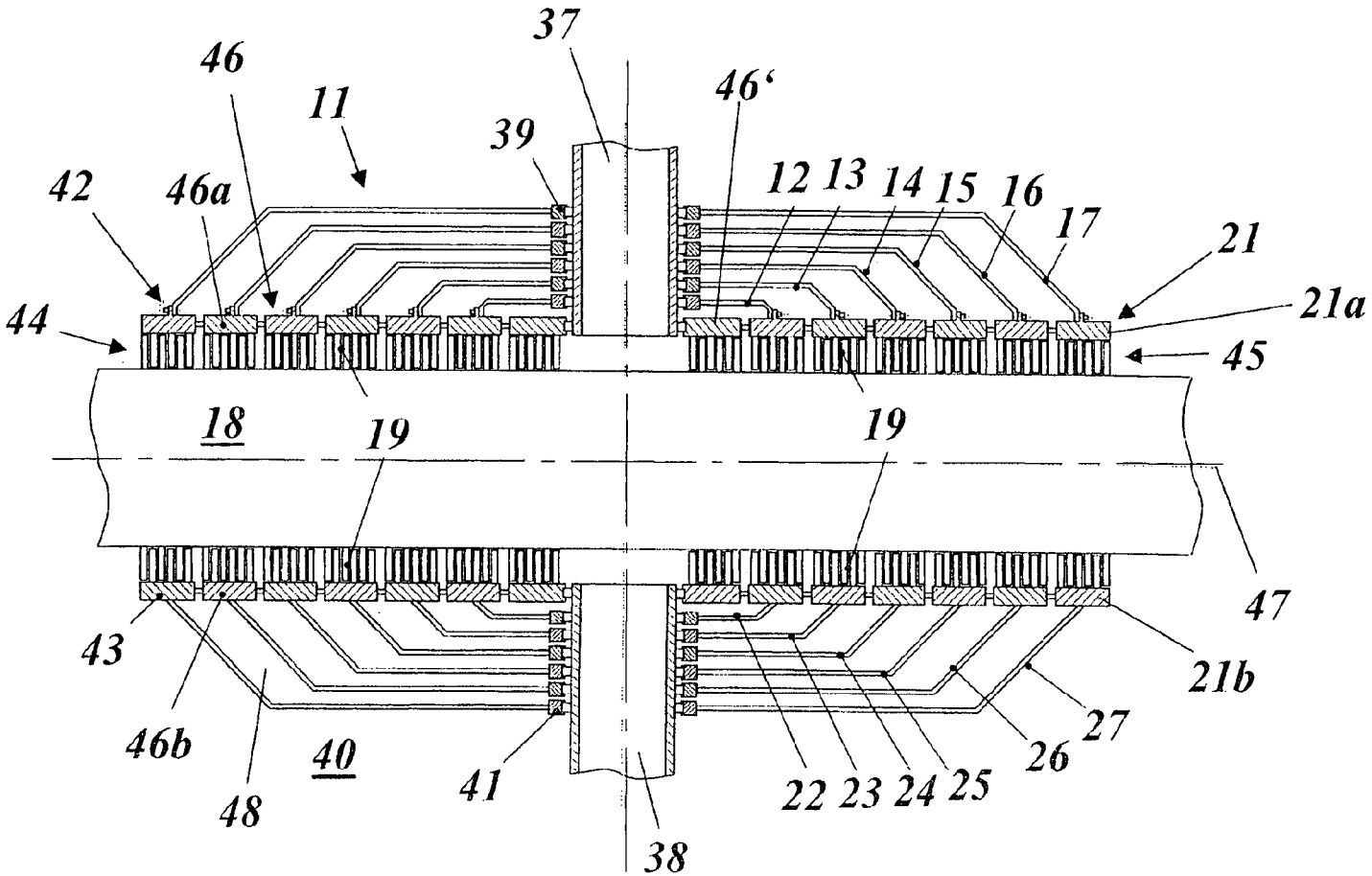
FIG. 3 shows a longitudinal section through a double-flow inner casing of the type illustrated in FIG. 1, with the central inlet pipes for the steam inlet.

FIG. 3 shows a longitudinal section through a double-flow inner casing 11 of a steam turbine 40. The inner casing 11 again comprises a basic carrier 21 with an upper part 21*a* and lower part 21*b* and also upper shells 12, . . . ,17 and lower shells 22, . . . ,27. The rotor 18 rotates about the axis 47. A flow 44 and 45 together with the corresponding blading 19 is arranged on each of the two sides of central inlet pipes 37, 38. The steam flows through the inlet pipes 37 (top) and 38 (bottom) to the rotor 18 and is then apportioned to a left flow 44 with the blading 19 and to a right flow 45 with the blading 19. The inlet pipes 37 and 38 are led via piston ring seals 39 (top) and 41 (bottom) through the upper shells 12, 13, 14, 15, 16, 17 and the lower shells 22, 23, 24, 25, 26, 27 and the innermost ring (carrier segment 46') of the basic carrier 21.

The basic carrier 21, on the one hand, is divided horizontally into an upper part 21*a* and a lower part 21*b* and, on the other hand, is subdivided axially into carrier segments 46 (more precisely, segment halves 46*a, b*) which carry the guide vanes of the blading 19 on the insides and to which the upper and lower shells 12, . . . ,17 and 22, . . . ,27 are fastened. In the example of FIG. 3, six carrier segments 46 (12 segment halves 46*a,b*) are provided on each of the two sides of the innermost carrier segment 46' through which the inlet pipes 37, 38 are led. The individual carrier segments 46 are connected to one another in such a way that steam can flow out of the steam duct into the interspaces 48 of the upper and lower shells. For mounting the upper shells 12, 13, 14, 15, 16, 17, it is necessary to screw these to the upper segment halves 46*a* of the basic carrier 21 by means of a semiannular flanged connection 42. The lower shells 22, 23, 24, 25, 26, 27 can be connected to the lower segment halves 46*b* by means of weld seams 43.

In FIG. 3, the connection of the upper and lower shells 12, 13, 14, 15, 16, 17 and 22, 23, 24, 25, 26, 27 to the basic carrier 21 takes place axially, in each case approximately at the segment center. If, however, this screw or welded connection is formed at that end of the carrier segment 46 which is directed downstream with respect to the steam flow, the carrier segment 46 of the basic carrier 21 is acted upon by an external pressure. The horizontal flange screws which hold together the upper and lower part 21*a, b* of the basic carrier 21 may then have a very small design or they may even be dispensed with completely.

Figure 4:
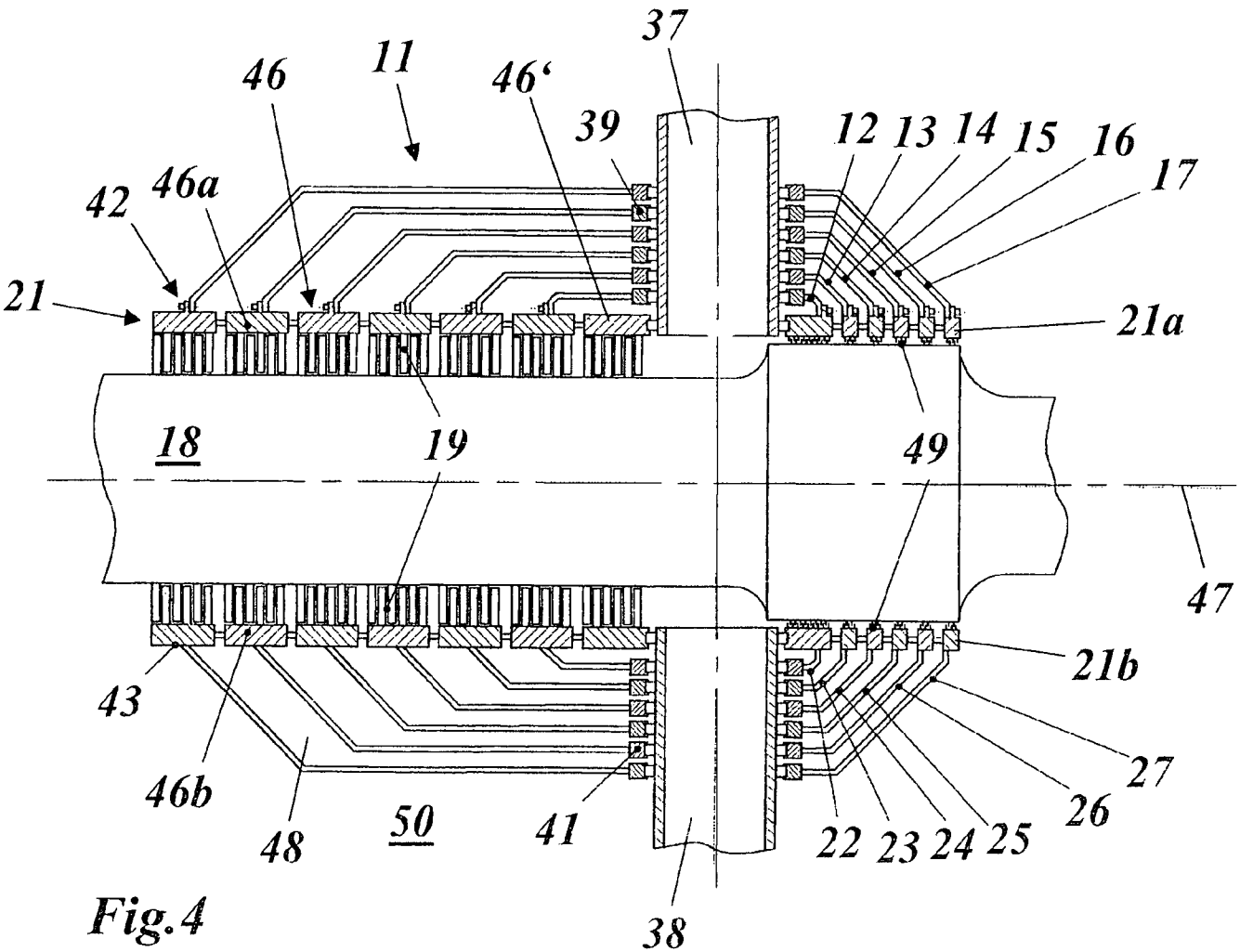
FIG. 4 shows an illustration, comparable to FIG. 3, of a single-flow inner casing of the type illustrated in FIG. 1.

FIG. 4 shows a longitudinal section through a single-flow inner casing 11 of a steam turbine 50. The steam flows through the inlet pipes 37 (top) and 38 (bottom) to the rotor 18 and then to the left through the blading 19. A residual steam flows through the casing seal 49 (here, labyrinth seal) arranged on the right side. The inlet pipes 37 and 38 are led via piston ring seals 39 (top) and 41 (bottom) through the upper shells 12, 13, 14, 15, 16, 17 and the lower shells 22, 23, 24, 25, 26, 27 and the inner carrier segment 46' of the basic carrier 21. The inner carrier segment 46' carries the first guide vanes of the blading 19 on the left side and the casing seals 49 on the right side. The carrier segments 46 on the right of this inner carrier segment 46' carry the further casing seals, and the carrier segments 46 on the left of this inner carrier segment 46' carry the further guide vanes. Between the carrier segments 46, 46' are orifices which allow the steam to flow into the interspaces 48 of the upper and lower shells. Between the carrier segments 46, 46' which carry the casing seals, these orifices may be dispensed with. This rules out the situation where hot steam flows out of the seals into the interspaces 48 of the upper and lower shells. The seals should, however, be designed in such a way that the pressure difference between the interspaces 48 and the seals 49 is low. Preferably, the pressure in the interspaces should be slightly higher, so that, in the event of a leak, colder steam flows out of the interspace into the seal, not vice versa.

For mounting the upper shells 12, 13, 14, 15, 16, 17, it is necessary to screw these to the upper segment halves 46*a* of the basic carrier 21 by means of a semiannular flanged connection 42. Should the turbine not have to be dismantled again, the upper shells 12, 13, 14, 15, 16, 17 may also be connected to the upper segment halves 46*a* of the basic carrier 21 by means of a welded connection.

The lower shells 22, 23, 24, 25, 26, 27 may again be connected to the lower segment halves 46*b* by means of weld seams 43.

Figure 5:
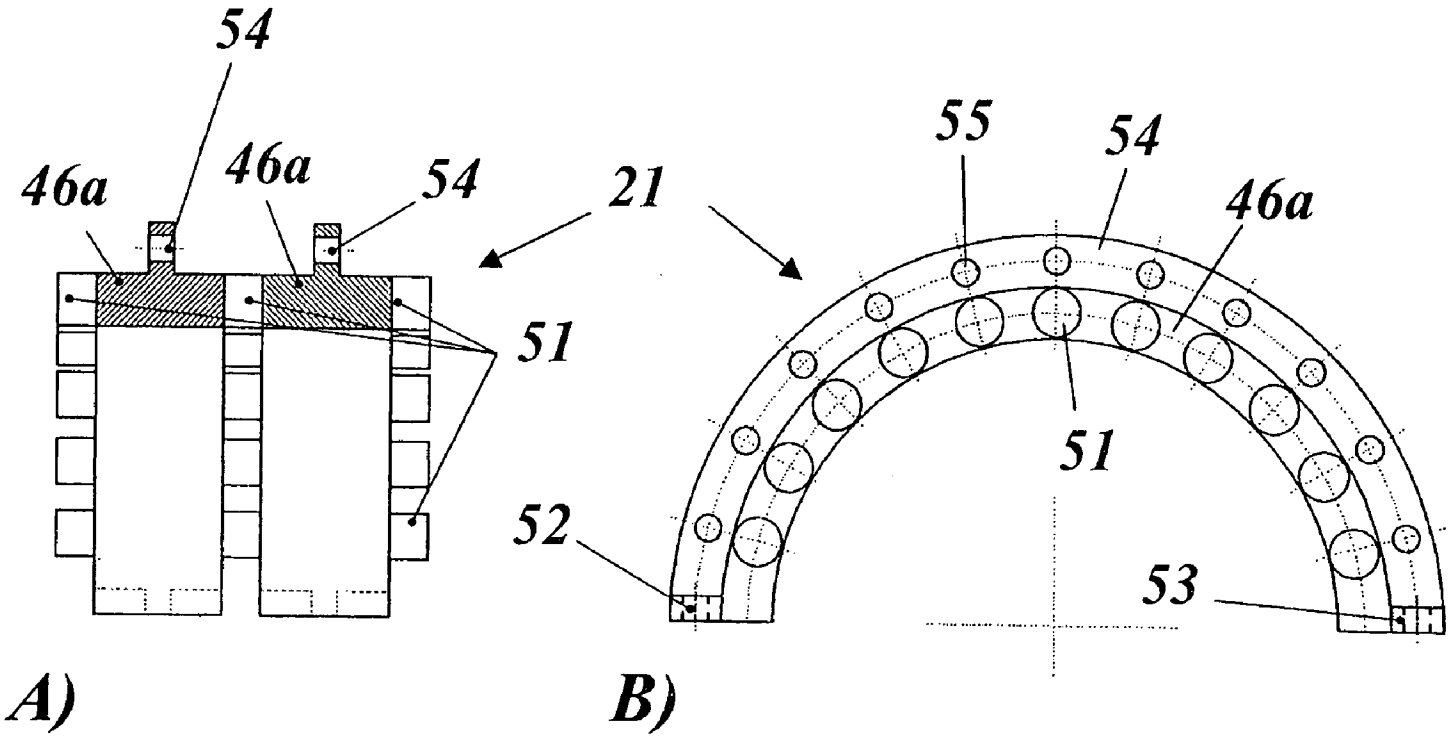
FIG. 5 shows, in two views from the side and in the axial direction (part FIGS. 5A and B), two upper segment halves of a basic carrier according to the present invention which are welded to one another via short round bars.

FIG. 5 shows two upper segment halves 46*a* of a basic carrier 21. In the example illustrated, the segment halves 46*a* are connected to short round bars 51, for example by welding. The segment halves 46*a* themselves may consist, for example, of bent sheet metal or of forged half rings. The round bars 51 for the adjacent segment halves not yet welded on are also illustrated. The voids between the round bars 51 allow the steam to flow into the interspaces 48 of the upper and lower shells (see FIGS. 3 and 4). Round flanges 54 with bores 55 distributed over the circumference are attached to the segment halves 46*a*, the upper shells (12, . . . ,17 in FIG. 1 to 4) being screwed to said round flanges. Furthermore, horizontal flange halves 52 and 53 are attached, by means of which the upper segment halves 46*a* illustrated can be screwed to the associated lower segment halves (not illustrated).

Figure 6:
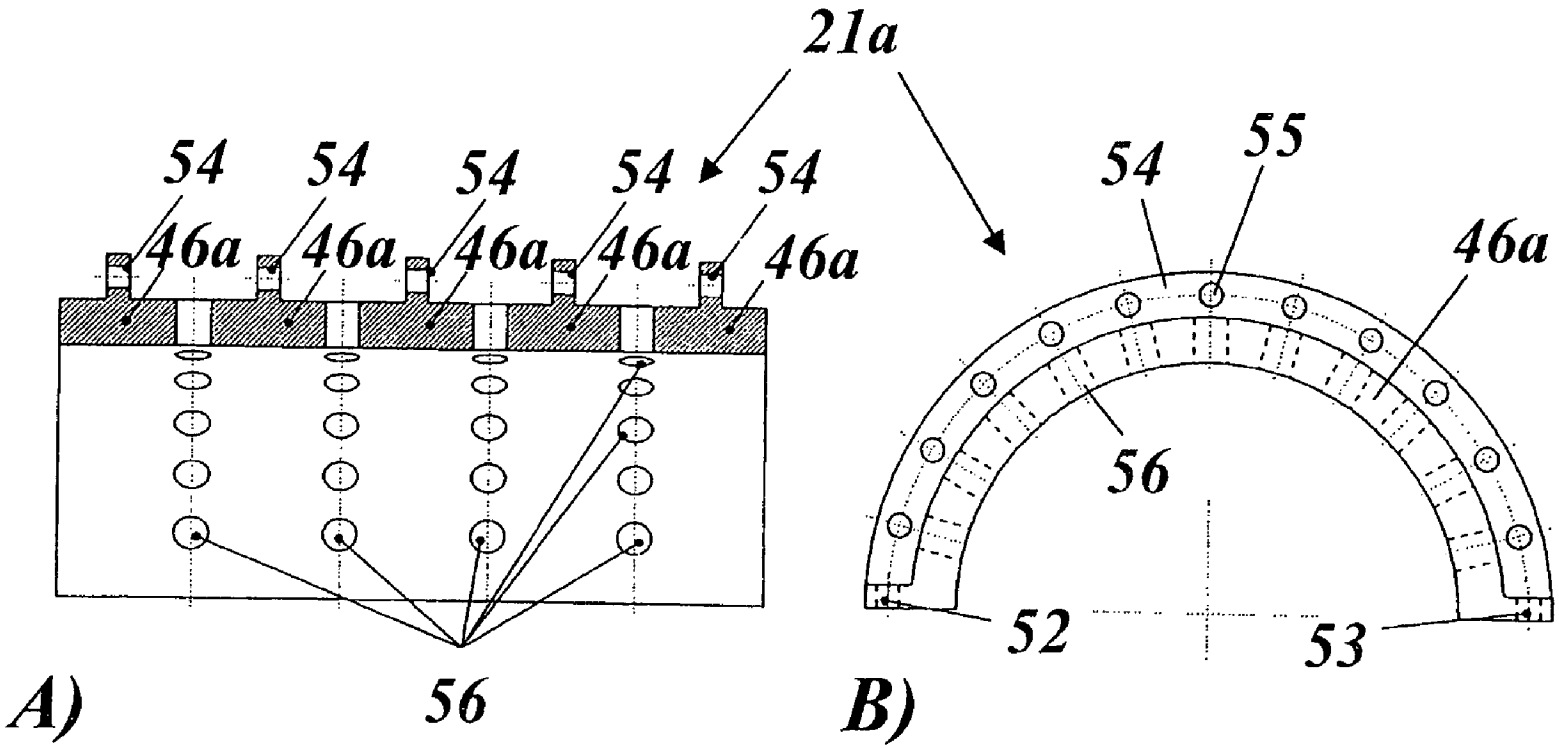
FIG. 6 shows, in an illustration comparable to FIG. 5, the upper half, cast or forged in one piece, of a basic carrier according to the present invention, in which the radial passage of steam between the segments is ensured by means of bores.

FIG. 6 shows the upper half or the upper part 21*a* of a basic carrier 21. In contrast to FIG. 5, the segment halves 46*a* are connected in that the entire upper part 21*a* of the basic carrier 21 is cast or forged in one piece. The permeability of the steam into the interspaces 48 of the upper and lower shells (see FIGS. 3 and 4) is ensured by means of bores 56. The round flanges 54 having the bores 55 are attached to the segment halves 46*a*, the upper shells being screwed to said round flanges. Furthermore, horizontal flange halves 52 and 53 are again provided, by means of which the illustrated upper part 21*a* of the basic carrier 21 can be screwed to the lower part 21*b* (not illustrated).

The claws and webs for the supports and guides of the casings 11 are not shown in the figures. Claws and webs are attached, for example, to the outermost carrier segments 46 of the basic carrier 21.

In the figures, the casing 11 is designed as an inner casing. However, an outer casing, too, may be produced in the multishell design according to the present invention with a stepped pressure reduction. Instead of the basic carrier segments with blading (left side in FIG. 4), basic carrier segments with casing seals 49 (right side in FIG. 4) are used on both sides.

The inner and outer casings configured according to the present invention may also be combined. For example, in FIG. 4, one or more shells are added on the outside, in which only seals are attached to the associated additional carrier segments of the basic carrier. Then, in a similar way to the inlet pipes 37 and 38, an outlet pipe with piston seals is led through these added shells, the steam being capable of flowing outward through said outlet pipe.

The bent shells (upper and lower shells) can be produced in a simple and cost-effective way by means of the method of end-controlled bending, as disclosed in German patent specification DE-C2-43 10 773.

For an exemplary 400-MW steam turbine with an HP and MP part, it is necessary in the HP part to have 5 shells consisting of Alloy 617 which have stepped wall thicknesses of 9 to 10.5 mm. The MP part has 3 shells consisting of Alloy 617 with stepped wall thicknesses of 3.8 to 5.8 mm. In each case 3 stages of the turbine (3 guide vane rings and 3 moving blade rings) are assigned to a carrier segment of the basic carrier.

Overall, the present invention affords the following advantages:

Starting of a 700° C./720° C. turbine possible within a few minutes (instead of 5 hours at the present time).

Reduced delivery time for the casing.

Cost saving with regard to the casing and to the casing screws.

Casings: standard metal sheets, if appropriate standardized, are used instead of cast iron (conventional design). The standardization results in a cost benefit. There is additionally also a cost benefit because less nickel-based material is required, since a change to the material of the next lower quality is possible directly in the next "onion skin".

Parting line screws: small screws are mass products or in any event can be manufactured everywhere and are therefore inexpensive.

As a result of standardization, the sheets and the individual segments of the basic carrier can be kept in stock. Standard sheets may also alternatively be procured from the sheet manufacturer's depot. The delivery time is thereby drastically reduced, since there is no dependence on the long delivery time of a casting foundry.

What is claimed is:

1. A steam turbine comprising:

a rotor rotatable about an axis; and a casing concentrically surrounding the rotor, wherein the casing includes a high-mass hollow cylindrical basic carrier and a plurality of shells concentrically surrounding the basic carrier, interspaces capable of being filled with steam being defined between adjacent ones of the plurality of shells, wherein each of the shells includes a bent metal sheet.

2. The steam turbine as recited in claim 1, wherein the basic carrier includes a plurality of annular carrier segments disposed adjacent to one another in an axial direction and connected to one another, wherein the plurality of shells are barrel-shaped so that each next outer shell of the plurality of shells surrounds the further inward-lying shells both in a radial and in the axial direction, and wherein each shell is connected on an end face of the shell in a steamtight manner to a respective one of the plurality of carrier segments.

3. The steam turbine as recited in claim 2, wherein the steam turbine defines a horizontal plane dividing the basic carrier into an upper part including upper carrier segment halves and a lower part including lower carrier segment halves and dividing the plurality of shells into upper shells and a lower shells, and wherein the upper and lower part are connected to each other, each upper segment half is connected to a respective lower segment half, and each upper shell is connected to a respective lower shell via a respective flanged screw connection.

4. The steam turbine as recited in claim 3, wherein each flanged screw connection includes a horizontal flange attached to at least one of a respective upper shell and a respective lower shell.

5. The steam turbine as recited in claim 4, wherein the horizontal flange is attached by welding.

6. The steam turbine as recited in claim 3, wherein each upper shell is screwed at a screw connection to a respective upper segment half, and each lower shell is welded to a respective lower segment half.

7. The steam turbine as recited in claim 6, wherein the screw connection includes a semiannular flanged connection.

8. The steam turbine as recited in claim 2, wherein the carrier segments are connected to one another so as to allow steam to flow out of an interior of the basic carrier into the interspaces.

9. The steam turbine as recited in claim 1, further comprising an inlet pipe configured to provide the steam for operating the steam turbine to the rotor from outside the casing through each of the shells, and a plurality of piston ring seals, each sealing off the inlet pipe as it passes through the respective shell.

10. The steam turbine as recited in claim 1, wherein the casing includes at least one of an inner casing and a combined inner and outer casing, wherein a steam duct is defined between the basic carrier and the rotor, and further comprising a blading disposed in the steam duct, the blading including moving blades and guide vanes, the guide vanes being connected to an inner wall of the basic carrier.

11. The steam turbine as recited in claim 10, wherein the basic carrier includes a plurality of annular carrier segments disposed adjacent to one another in an axial direction and connected to one another, and further comprising a plurality of successive stages disposed within each carrier segment.

12. The steam turbine as recited in claim 11, wherein the plurality of successive stages includes three stages disposed within each carrier segment.

13. The steam turbine as recited in claim 10, wherein the casing is one of a single-flow casing and a double-flow casing.

14. The steam turbine as recited in claim 1, wherein the casing includes an outer casing.

15. The steam turbine as recited in claim 1, wherein the bent metal sheet includes at least a portion of a standard metal sheet including a high-temperature nickel-based alloy and a sheet thickness of several millimeters.

16. The steam turbine as recited in claim 15, wherein the high-temperature nickel-based alloy includes Alloy 617.

17. The steam turbine as recited in claim 15, wherein the sheet thickness is between 3 and 11 millimeters.

18. The steam turbine as recited in claim 15, wherein the sheet thickness of each shell depends upon a position of the shell within the casing.

19. A method for producing a steam turbine as recited in claim 1, the method comprising:

forming each of the plurality of shells by performing a free plastic bending of a straight metal sheet.

20. The method as recited in claim 19, wherein the straight metal sheet includes a standard metal sheet having a high-temperature nickel-based alloy.

* * * * *